US011965314B2

(12) United States Patent
Garramone et al.

(10) Patent No.: US 11,965,314 B2
(45) Date of Patent: Apr. 23, 2024

(54) CONTROL METHODS FOR ACTUATING THE MOVEMENT OF A BOOM OR AN ATTACHMENT IN A WORK VEHICLE, CORRESPONDING CONTROL SYSTEMS AND WORK VEHICLES COMPRISING SUCH CONTROL SYSTEMS

(71) Applicant: CNH Industrial America LLC, New Holland, PA (US)

(72) Inventors: Adriano Garramone, Lecce (IT); Andrea Gravili, Lecce (IT); Stefano Liberti, Lecce (IT); Antonio Venezia, Turin (IT)

(73) Assignee: CNH Industrial America LLC, New Holland, PA (US)

( * ) Notice: Subject to any disclaimer, the term of this patent is extended or adjusted under 35 U.S.C. 154(b) by 353 days.

(21) Appl. No.: 17/516,324

(22) Filed: Nov. 1, 2021

(65) Prior Publication Data

US 2022/0136213 A1 May 5, 2022

(51) Int. Cl.

| | |
|---|---|
| ***E02F 3/43*** | (2006.01) |
| ***E02F 9/20*** | (2006.01) |
| ***E02F 9/22*** | (2006.01) |

(52) U.S. Cl.

CPC ..... *E02F 9/2228* (2013.01); *E02F 9/2267* (2013.01); *E02F 9/2271* (2013.01); *E02F 9/2004* (2013.01)

(58) Field of Classification Search

CPC ..... E02F 9/2228; E02F 9/2267; E02F 9/2271; E02F 9/2004; E02F 3/431; E02F 9/2012;

(Continued)

(56) References Cited

U.S. PATENT DOCUMENTS 5,510,987 A 4/1996 Song
5,537,818 A * 7/1996 Hosseini ..... E02F 9/2214 91/461

(Continued)

FOREIGN PATENT DOCUMENTS

| | | |
|---|---|---|
| EP | 1426499 | 6/2004 |
| JP | 2016125282 | 7/2016 |

OTHER PUBLICATIONS

Search Report for Italian application 102020000025864, dated Aug. 5, 2021 (10 pages).

*Primary Examiner* — Adam R Mott
*Assistant Examiner* — Byron Xavier Kasper
(74) *Attorney, Agent, or Firm* — Rickard K. DeMille; Rebecca L. Henkel; Peter K. Zacharias

(57) ABSTRACT

A method for actuating the movement of a boom, or an attachment, in a work vehicle includes determining a joystick position difference between the actual component of the position of the joystick along a boom, or attachment, actuation axis in a first time instant and a neutral position of the joystick along the boom, or attachment, actuation axis, determining a first position of the boom, or attachment, along the boom travel path in the first time instant, and a second position of the boom, or attachment, along the boom travel path in a second time instant, and determining a boom, or attachment, position difference between the second position and the first position. If the determined boom, or attachment, position difference is lower than a threshold and the determined joystick position difference is higher than a joystick position difference threshold, the method also includes slowing movement of the boom, or attachment.

10 Claims, 6 Drawing Sheets

(58) Field of Classification Search
CPC . E02F 3/286; E02F 3/3402; E02F 9/22; E02F 9/2214; E02F 9/265; E02F 3/43; B60P 1/6472; B60P 1/4471; B60W 2200/224; B60W 2300/154; B66F 9/0655; B66F 9/205; B66C 23/00; B66C 13/18; E01C 19/475
See application file for complete search history.

(56) References Cited

U.S. PATENT DOCUMENTS

| | | | | |
|---|---|---|---|---|
| 5,735,065 | A * | 4/1998 | Yamagata | E02F 3/437 701/50 |
| 2007/0033934 | A1 | 5/2007 | Yamazaki et al. | |
| 2017/0145662 | A1 | 5/2017 | Iwasaki et al. | |
| 2019/0177948 | A1* | 6/2019 | Matsuyama | E02F 3/437 |
| 2019/0360179 | A1 | 11/2019 | Moriki et al. | |

* cited by examiner

CONTROL METHODS FOR ACTUATING THE MOVEMENT OF A BOOM OR AN ATTACHMENT IN A WORK VEHICLE, CORRESPONDING CONTROL SYSTEMS AND WORK VEHICLES COMPRISING SUCH CONTROL SYSTEMS

PRIORITY CLAIM

This application claims priority to Italian Patent Application No. 102020000025864 filed Oct. 30, 2020, titled "Control methods for actuating the movement of a boom or an attachment in a work vehicle, corresponding control systems and work vehicles comprising such control systems", and which is incorporated herein by reference.

BACKGROUND OF THE INVENTION

Technical Field

The present invention relates generally to a work vehicle, such as for example a compact wheel loader, and particularly to control methods for actuating the movement of a boom or an attachment in a work vehicle, corresponding control systems and work vehicles comprising such control systems.

Prior Art

Motorized work vehicles are well known for use in material handling that carry an attachment (for example, a bucket) and have a hydraulically operated lifting arm for moving the attachment. Examples of such vehicles are tractors and loaders.

A loader is a heavy equipment machine used in construction to move aside on the ground or load materials such as asphalt, demolition debris, dirt, snow, feed, gravel, logs, raw minerals, recycled material, rock, sand, woodchips, etc. into or onto another type of machinery (such as a dump truck, conveyor belt, feed-hopper, or railroad car). There are many types of loader, which, depending on design and application, are called by various names, including attachment loader, front loader, front-end loader, payloader, scoop, shovel, skip loader, wheel loader, or skid-steer. In particular, compact wheel loaders are compact vehicles that have road wheels and carry a working attachment, such as an attachment, attached to a lift arm or boom, that is hydraulically powered.

Referring to FIG. 1, a work vehicle 1, such as a compact wheel loader, is shown. However, the invention is not limited to such a kind of work vehicle, but is applicable to any other kind of work vehicle.

A compact wheel loader includes an attachment 2 connected to a frame 3 of the work vehicle for movement relative thereto. As shown, a boom 5 is pivotally connected at one end on opposite sides of frame 3. The attachment 2 is pivotally connected at the opposite end of the boom for tilting movement relative to the frame 3 about a generally horizontal axis. The above-described features form no substantial part of the present invention and are generally well known in the art. An attachment, e.g. a bucket, may be replaced in operation by any other type of attachment, e.g. a blade.

Usually, the movement of the boom 5 and of the attachment 2 is controlled by the operator through a joystick 7 placed inside an operator's cab or cabin 9 of the work vehicle 1.

As can be seen in FIG. 2, which shows a control diagram of the work vehicle 1, the boom 3 and the attachment 2 are moved by an hydraulic control circuit 10 comprising a first and a second hydraulic actuators 12, 14 which are controlled by an electronic control unit 16 through respective solenoid valves 18, 20 according to the position of the joystick 7 controlled by the operator.

For example, each hydraulic actuator comprises an hydraulic cylinder operatively connected respectively to the boom and the attachment, that uses hydraulic power of a working fluid to facilitate mechanical operation, the working fluid being controlled by means of directional solenoid valves 18, 20, e.g. an open centre valve. As liquids are nearly impossible to compress, a hydraulic actuator can exert a large force. The rate of actuation of the boom and attachment is controlled by the opening degree of the respective directional solenoid valve 18, 20 by means of a driving current thereof as a function of the position of the joystick.

The hydraulic flow rate of the working fluid required to operate the boom and the attachment is produced by a hydraulic pump Pu connected to a fluid reservoir T and driven by an internal combustion engine or an electrical motor M (hereinafter simply referred to as motor) of the vehicle, e.g. by a mechanical linkage. The same motor is also used to drive the wheels as a propulsion means of the work vehicle.

FIG. 3 shows an exemplary joystick of a work vehicle. A movement of the joystick in an associated bi-dimensional control area A according to a first direction y causes the actuation of the boom and a movement of the joystick in the bi-dimensional control area A according to a second direction x causes the actuation of the attachment. The intersection of the x and y directions is defined as origin O of the control area A, and corresponds to the neutral position of the joystick.

A neutral region N around the neutral position of the joystick is a region where the boom and attachment are not actuated. A region externally surrounding the neutral region is defined a driving region and indicated D in this figure.

For example, according to the orientation depicted in FIG. 3, when the joystick is moved up from the origin O of the control area A according to the y direction the boom is lowered with respect to ground and when the joystick is moved down from the origin O according to the y direction the boom is lifted towards ground. Further, when the joystick is moved right from the origin O according to the x direction the attachment, is tilted towards a dumping position, and when the joystick is moved left from the origin O according to the x direction the attachment, is tilted towards a dig or rollback position and beyond.

A combination of movement in both directions x and y of the joystick is allowed in order to move simultaneously the boom and the attachment.

In known work vehicles, even if the boom and/or the attachment reach their respective end-of-stroke positions, if the operator does not put the joystick into the neutral position N, the hydraulic actuator will keep actuated the boom and/or the attachment. Disadvantageously, this aspect involves a waste of fuel by the working machine.

SUMMARY OF THE INVENTION

The aim of the present invention is to provide a solution that avoids the drawbacks of the prior art.

Particularly, an aim of the present invention is to reduce the waste of fuel by the working machine when the boom and/or the attachment reach their respective end-of-stroke positions.

According to the invention, this aim is achieved by a control method for actuating the movement of a boom in a work vehicle powered by a motor, having the features claimed in claim 1, or a control method for actuating the movement of an attachment attached to a boom in a work vehicle powered by a motor, having the features claimed in claim 3.

Preferred embodiments are defined in the dependent claims, whose content is also to be considered an integral part of the present description. Features of the dependent claims may be combined with the features of the independent claims as appropriate, and in combinations other than those explicitly set out in the claims.

Further subjects of the invention are control systems for a work vehicle powered by a motor, as well as work vehicles, as claimed.

In summary, an actuation strategy of a boom and/or an attachment of a work vehicle is disclosed. In the actuation strategy, the boom and attachment commands are deactivated when the boom and the attachment reach their respective end-of-stroke positions.

BRIEF DESCRIPTION OF THE DRAWINGS

Further functional and structural characteristics and advantages of the present invention are set out in the detailed description below, provided purely as a non-limiting example, with reference to the attached drawings, in which.

DETAILED DESCRIPTION

In the following description, unless otherwise defined, all terms (including technical and scientific terms) are to be interpreted as is customary in the art. It will be further understood that terms in common usage should also be interpreted as is customary in the relevant art and not in an idealized or overly formal sense unless expressly so defined herein. All orientation terms, such as upper and lower, are used in relation to the drawings and should not be interpreted as limiting the invention.

In the following, a preferred embodiment of a control method for actuating the movement of a boom in a work vehicle powered by a motor is described. Reference is made to the control diagram of FIG. 4, where the electronic control unit 16 may be configured to implement the control method of the invention.

Figure 1:
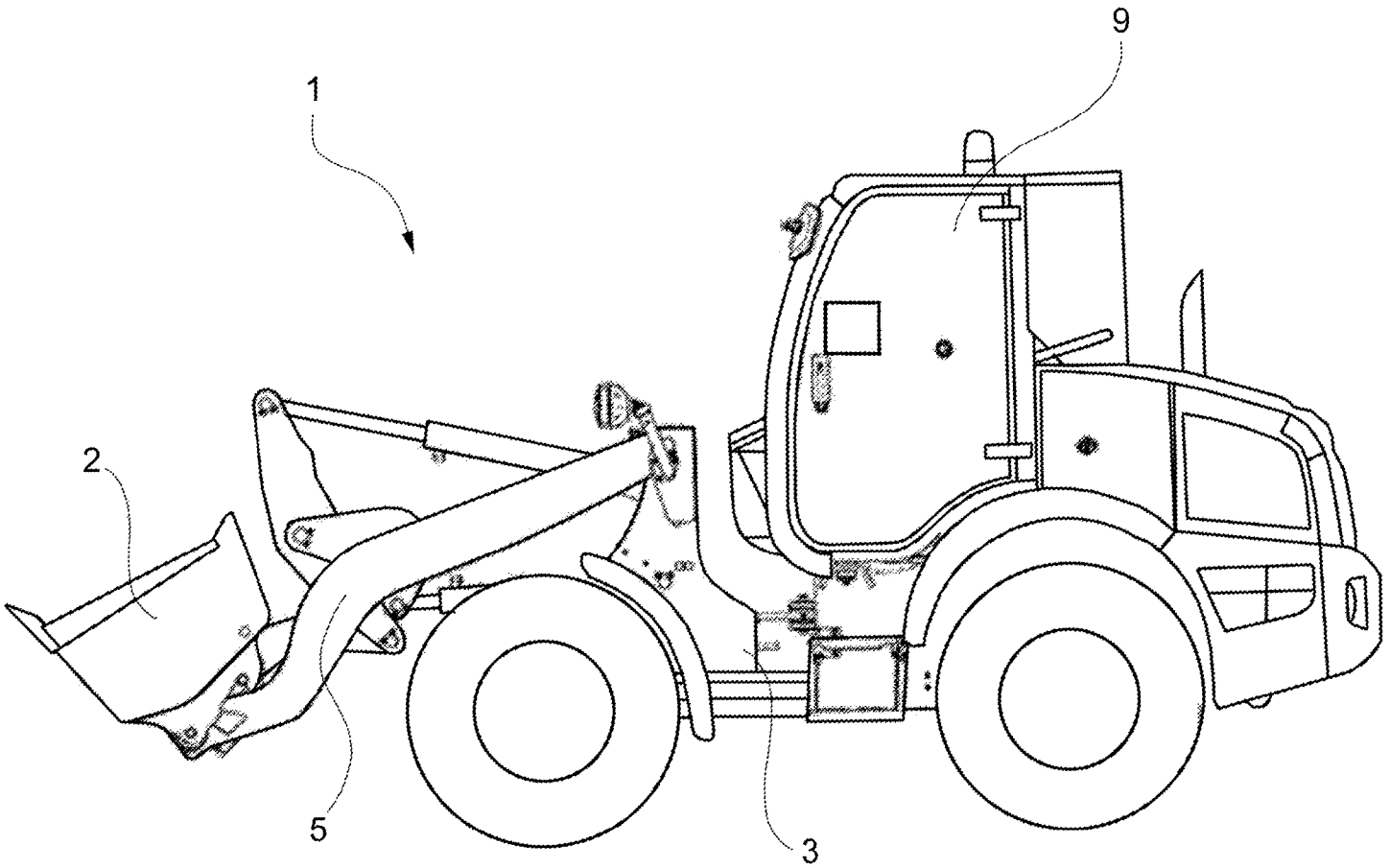
FIG.1 (PRIOR ART)
FIG. 1 shows a prior art exemplary work vehicle, in particular a compact wheel loader.
Figure 2:
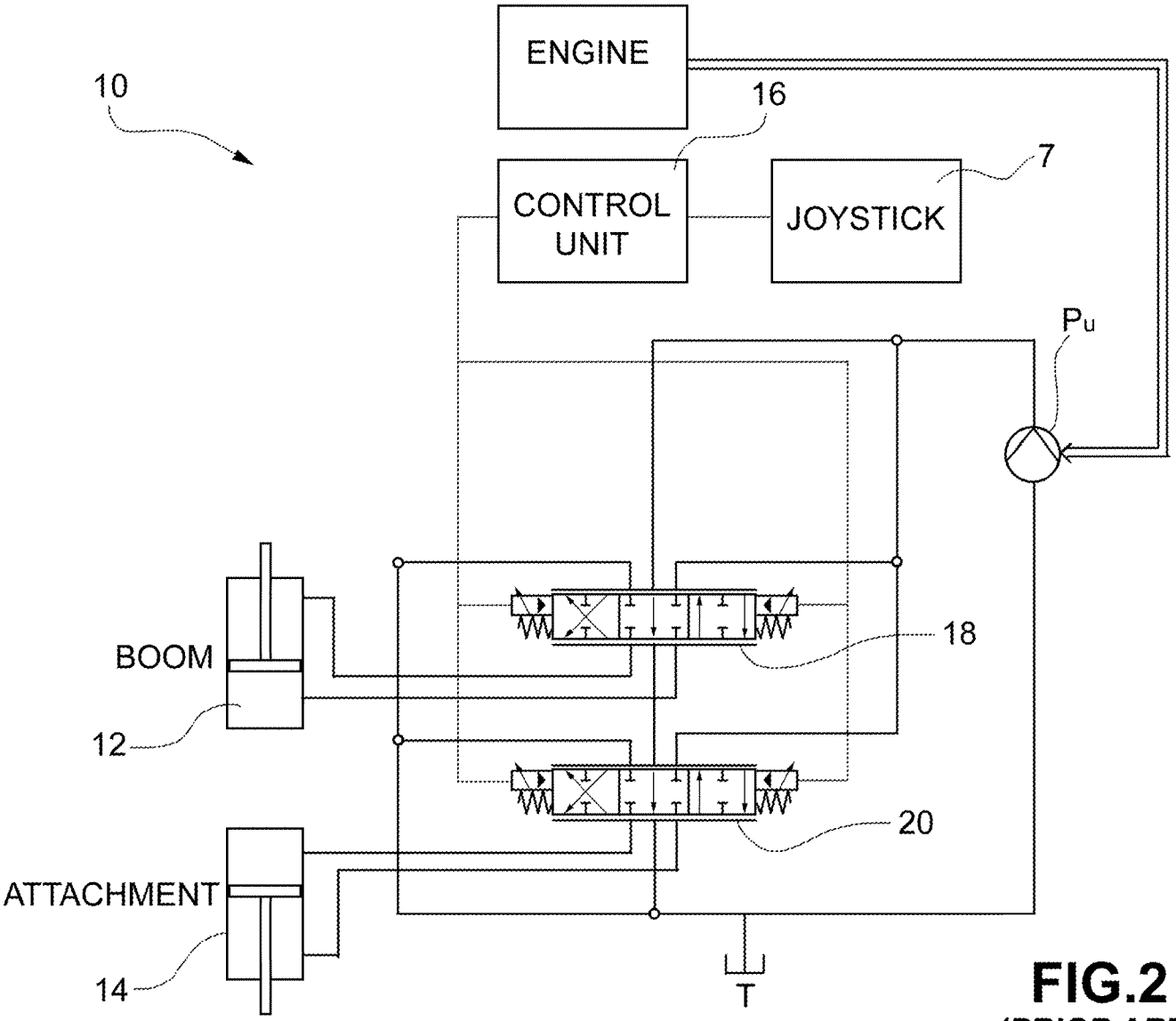
FIG.2 (PRIOR ART)
FIG. 2 shows a prior art control diagram of a work vehicle.
Figure 3:
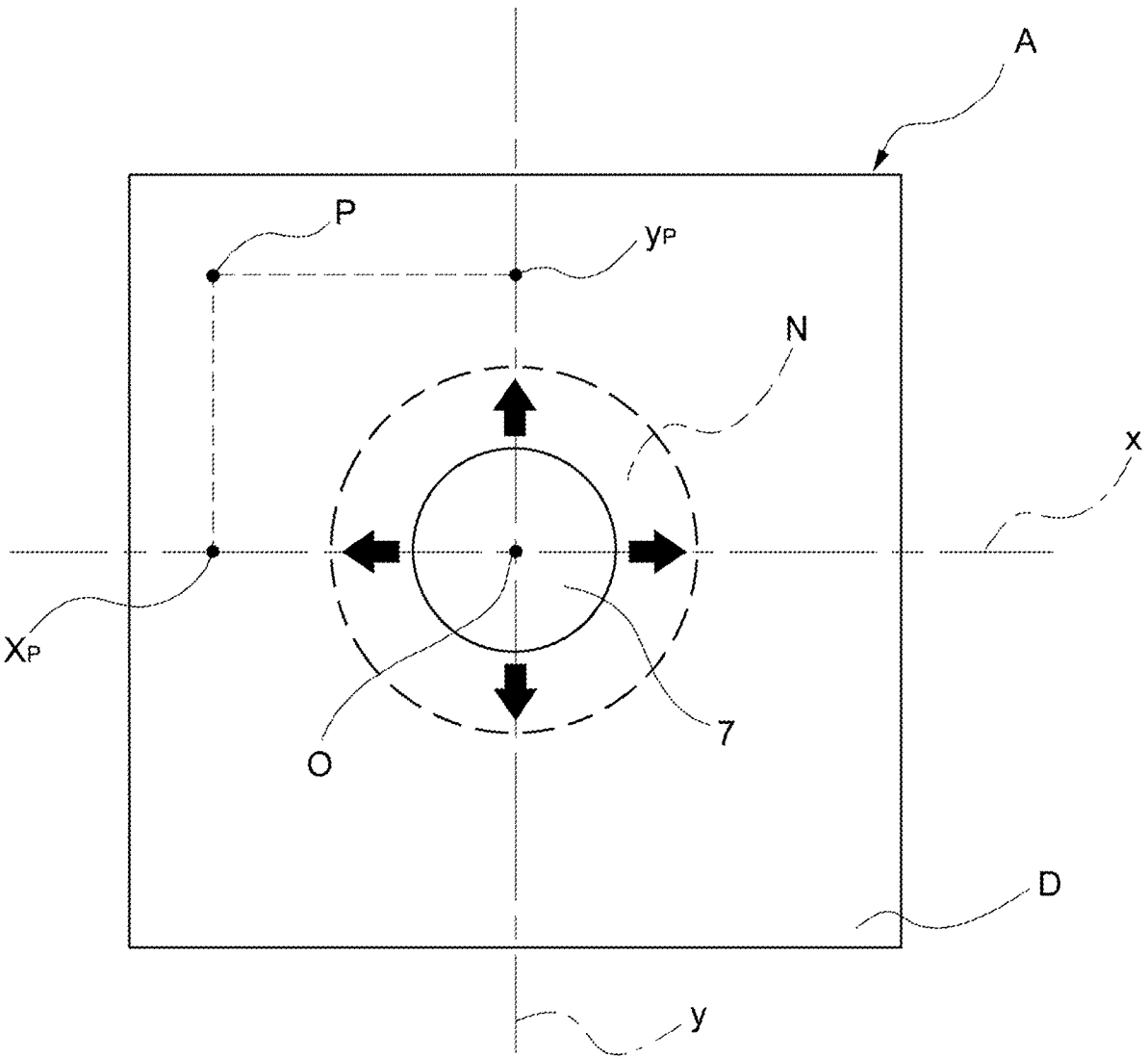
FIG.3 (PRIOR ART)
FIG. 3 shows a prior art exemplary joystick of a work vehicle.

As disclosed above and with further reference to FIG. 3, the actuation of the boom occurs by means of a joystick controlled by an operator. A movement of the joystick in the predetermined control area according to a preset boom actuation axis causes the actuation of the boom by hydraulic actuating means.

The hydraulic actuating means include an hydraulic cylinder operatively connected the boom, and a directional solenoid valve whose opening degree is adapted to control the flow of a working fluid to the hydraulic cylinder.

The rate of actuation of the boom is controlled by the opening degree of the directional solenoid valve by means of a driving current thereof as a function of a component of the position of the joystick along the preset boom actuation axis in the control area.

The control method comprises the following steps of:

a) acquiring, a signal or data indicative of the position of the joystick along the preset boom actuation axis and a signal or data indicative of the position of the boom along a boom travel path over time;

b) based on the signal or data indicative of the position of the joystick, determining a joystick position difference between the actual component of the position of the joystick along the preset axis in a first time instant and a neutral position of the joystick along the preset axis;

c) based on the signal or data indicative of the position of the boom, determining a first position of the boom along the boom travel path in a first time instant;

d) based on the signal or data indicative of the position of the boom, detecting a second position of the boom along the boom travel path in a second time instant, successive with respect to the first time instant;

e) determining a boom position difference between the second position and the first position of the boom;

f) if the determined boom position difference is lower than a predetermined boom position difference threshold and the determined joystick position difference is higher than predetermined joystick position difference threshold, supplying a reduced driving current or a null driving current to the directional solenoid valve so as to slow down or stop the movement of the boom.

For example, the first time instant and the second time instant may be determined according to a predetermined sampling period.

In a preferred embodiment, the control method for actuating the movement of a boom may further comprise the step of acquiring a signal or data indicative of a rotational speed of the motor over time. The values of the predetermined joystick position difference threshold may be determined based on the rotational speed of the motor indicated by the signal or data indicative of the rotational speed of the motor.

For example, the predetermined joystick position difference threshold may be reduced for high rotational speeds of the motor or may be increased for low rotational speeds of the motor.

In a preferred embodiment, the control method for actuating the movement of a boom may further comprise the step of acquiring a signal or data indicative of operating mode of the work vehicle over time. The value of the predetermined boom position difference threshold may be determined based on the operating mode indicated by the signal or data indicative of the operating mode of the work vehicle.

Figure 5A:
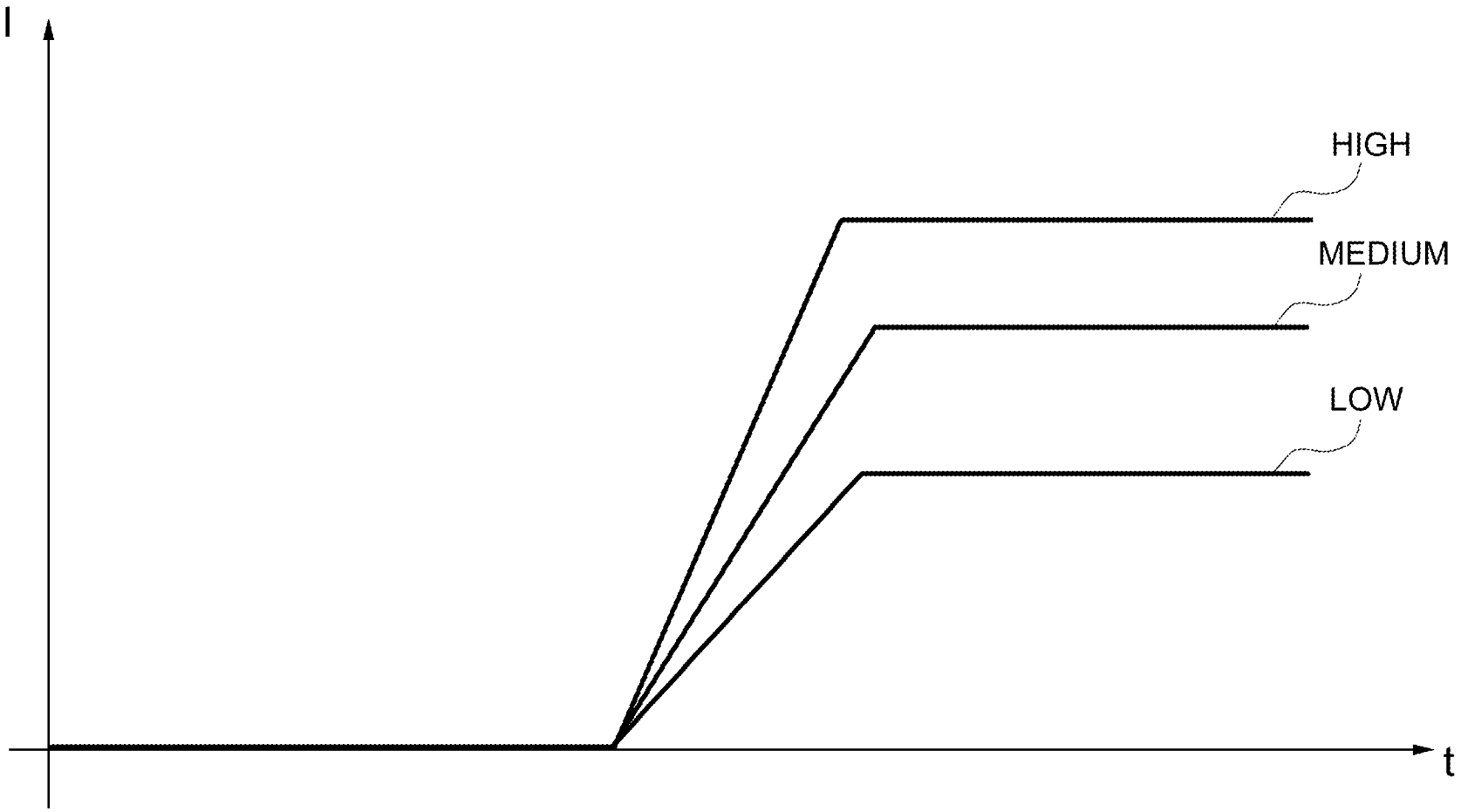
FIG. 5*a* shows a first exemplary case of curves representing the modified driving currents for three different operating modes (low, medium and high aggressiveness) of the work vehicle.
Figure 5B:
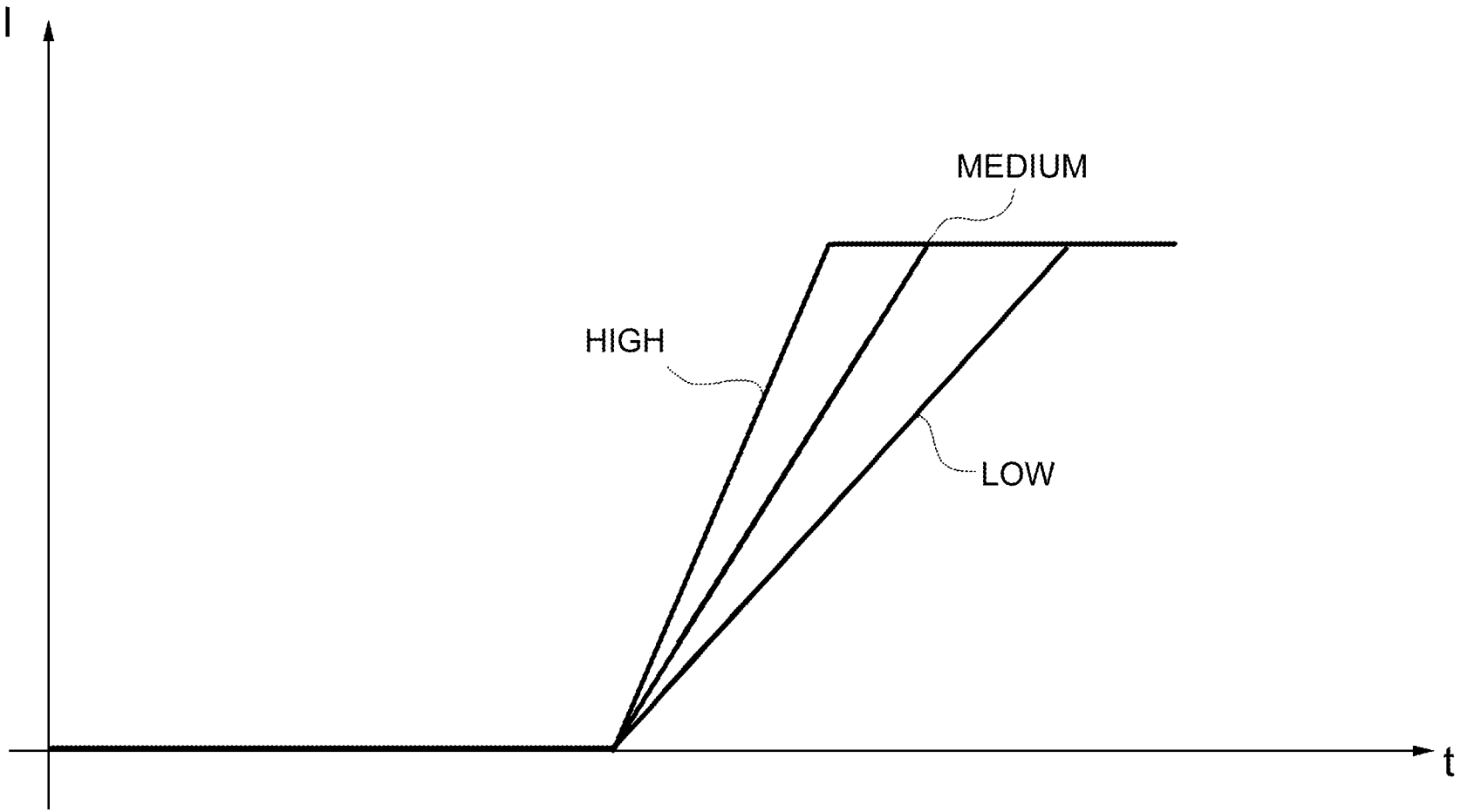
FIG. 5*b* shows a second exemplary case of curves representing the modified driving currents for three different operating modes (low, medium and high aggressiveness) of the work vehicle.

For example, the work vehicle may have a plurality of operating modes, selectable by the operator. The following explanation refers to an exemplary case of three different operating modes, see for example FIGS. 5*a* and 5*b*. In a first operating mode, e.g. low aggressiveness mode, a travel of the joystick from a first operating position to a second operating position along the preset axis determines a variation of the driving current according to a first increasing or decreasing rate over time. In a second operating mode, e.g. medium aggressiveness mode, a travel of the joystick from the first operating position to the second operating position along the preset axis determines a variation of the driving current according to a second increasing or decreasing rate over time, higher than the first increasing or decreasing rate. In a third operating mode, e.g. high aggressiveness mode, a travel of the joystick from the first operating position to the second operating position along the preset axis determines a variation of the driving current I according to a third increasing or decreasing rate over time, higher than the first and second increasing or decreasing rates.

In view of the above, the time interval between the first time instant of the first position of the boom and the second time instant of the second position of the boom, may be determined based on the operating mode indicated by the signal or data indicative of operating mode of the work vehicle. For example, the time interval of the high aggressiveness mode may be lower than the time interval of the medium aggressiveness mode, and the time interval of the medium aggressiveness mode may be lower than the time interval of the low aggressiveness mode.

Moreover, for example, the predetermined boom position difference threshold of the medium aggressiveness mode may be lower than the predetermined boom position difference threshold of the high aggressiveness mode, and the predetermined boom position difference threshold of the low aggressiveness mode may be lower than the predetermined boom position difference threshold of the medium aggressiveness mode.

The present invention relates also to a control method for actuating the movement of an attachment attached to a boom in a work vehicle powered by a motor.

The actuation of the attachment occurs again by means of the joystick controlled by an operator. A movement of the joystick in a predetermined control area according to a preset attachment actuation axis causes the actuation of the attachment by hydraulic actuating means. The preset attachment actuation axis for actuating the attachment may be for example an axis parallel to the preset boom actuation axis for the actuation of the boom.

The hydraulic actuating means include an hydraulic cylinder operatively connected the attachment, and a directional solenoid valve whose opening degree is adapted to control the flow of a working fluid to the hydraulic cylinder.

The rate of actuation of the attachment is controlled by the opening degree of the directional solenoid valve by means of a driving current thereof as a function of a component of the position of the joystick along the preset attachment actuation axis in the control area.

The control method comprises the steps of:

a) acquiring, a signal or data indicative of the position of the joystick along the preset attachment actuation axis and a signal or data indicative of the position of the attachment along an attachment travel path over time;
b) based on the signal or data indicative of the position of the joystick, determining a joystick position difference between the actual component of the position of the joystick along the preset axis in a first time instant and a neutral position of the joystick along the preset axis;
c) based on the signal or data indicative of the position of the attachment along the attachment travel path, determining a first position of the attachment along the attachment travel path in a first time instant;
d) based on the signal or data indicative of the position of the attachment along the attachment travel path, determining a second position of the attachment along the attachment travel path in a second time instant, successive with respect to the first time instant;
e) determining an attachment position difference between the second position and the first position of the attachment;
f) if the determined attachment position difference is lower than a predetermined attachment position difference threshold and the determined joystick position difference is higher than predetermined joystick position difference threshold, supplying a reduced driving current or a null driving current to the directional solenoid valve so as to slow down or stop the movement of the attachment.

In a preferred embodiment, the control method for actuating the movement of an attachment may further comprise the step of acquiring a signal or data indicative of operating mode of the work vehicle over time. In such a case, the value of the predetermined attachment position difference threshold may be determined based on the operating mode indicated by the signal or data indicative of operating mode of the work vehicle.

Also in this case, the time interval between the first time instant of the first position of the attachment and the second time instant of the second position of the attachment, may be determined over time based on the operating mode indicated by the signal or data indicative of operating mode of the work vehicle.

Also for the control method for actuating the movement of an attachment, the control method may further comprise the step of acquiring a signal or data indicative of the rotational speed of the motor of the work vehicle. The values of the predetermined joystick position difference threshold may be determined based on the rotational speed of the motor indicated by the signal or data indicative of the rotational speed of the motor of the work vehicle.

It is clear that the inventions regarding the control method for actuating the movement of a boom and the control method for actuating the movement of an attachment may be combined.

In such a case, the control method will be a control method for actuating the movement of the boom and the attachment attached to the boom in a work vehicle powered by a motor.

Accordingly, the actuation of the boom occurs by means of a joystick controlled by the operator. A movement of the joystick in a predetermined control area according to the preset boom actuation axis causes the actuation of the boom by first hydraulic actuating means. The actuation of the attachment occurs again by means of the joystick controlled by the operator, a movement of the joystick in the predetermined control area according to the preset attachment actuation axis, different from the preset boom actuation axis, causes the actuation of the attachment by second hydraulic actuating means.

The first hydraulic actuating means include a first hydraulic cylinder operatively connected the boom, and a first directional solenoid valve whose opening degree is adapted to control the flow of a working fluid to the first hydraulic cylinder. The rate of actuation of the boom is controlled by the opening degree of the first directional solenoid valve by means of a driving current thereof as a function of a component of the position of the joystick along the preset boom actuation axis in the control area.

The second hydraulic actuating means include a second hydraulic cylinder operatively connected the attachment, and a second directional solenoid valve whose opening degree is adapted to control the flow of a working fluid to the second hydraulic cylinder. The rate of actuation of the attachment is controlled by the opening degree of the second directional solenoid valve by means of a driving current thereof as a function of a component of the position of the joystick along the preset attachment actuation axis in the control area.

For example, the rate of actuation of the boom 5 is controlled by the opening degree of the first directional solenoid valve 18 by means of the driving current thereof as a function of a first component of the position P of the joystick 7 along the preset boom actuation axis y in the control area A. The rate of actuation of the attachment 2 is controlled by the opening degree of the second directional solenoid valve 20 by means of the driving current thereof as a function of a second component of the position P of the joystick 7 along the preset attachment actuation axis x in the control area A. The first component of the position P of the joystick 7 along direction y is indicated $y_P$ in FIG. 3 and is the projection over y axis of a vector representing the position P of the joystick in the control area A. The second component of the position P of the joystick 7 along direction x is indicated $x_P$ in FIG. 3 and is the projection over x axis of the vector representing the position P of the joystick in the control area A. First and second components $y_P$, $x_P$ of the position P of the joystick may take on any combination of a "positive" value and a "negative" value on the y axis and x axis, respectively with respect to origin O of the control area A that corresponds to the neutral position of the joystick. A travel of the joystick from a first operating position to a second operating position where at least one of the first and the second component of the joystick position is reversed with respect to the neutral position, i.e. passes through a null value, is defined as a "direction inversion manoeuvre" of at least one of the boom and the attachment. As an example, a travel of the joystick along the y direction and passing through the neutral position corresponds to an inversion manoeuvre of the movement of the boom—from lifting to lowering or vice versa. As another example, a travel of the joystick along the x direction and passing through the neutral position corresponds to an inversion manoeuvre of the movement of the attachment—from dumping to rollback or vice versa.

As a further example, a travel of the joystick along a straight direction at an angle from the x axis and the y axis and passing through the neutral position corresponds to an inversion manoeuvre of both the movement of the boom—from lifting to lowering or vice versa—and the attachment—from dumping to rollback or vice versa.

The control method for actuating both the boom and the attachment comprises the steps of:

a) acquiring, a signal or data indicative of the position of the joystick along the preset boom actuation axis and the preset attachment actuation axis, acquiring a signal or data indicative of the position of the boom along the boom travel path, and acquiring a signal or data indicative of the position of the attachment along the attachment travel path;

b) based on the signal or data indicative of the position of the joystick, determining a first joystick position difference between the actual component of the position of the joystick along the preset boom actuation axis in a first time instant and a neutral position of the joystick along the preset boom actuation axis;

c) based on the signal or data indicative of the position of the boom, determining a first position of the boom along a boom travel path in a first time instant;

d) based on the signal or data indicative of the position of the boom, determining a second position of the boom along the boom travel path in a second time instant, successive with respect to the first time instant;

e) determining a boom position difference between the second position and the first position of the boom;

f) if the determined boom position difference is lower than a predetermined boom position difference threshold and the first determined joystick position difference is higher than a first predetermined joystick position difference threshold, supplying a reduced driving current or a null driving current to the first directional solenoid valve so as to slow down or stop the movement of the boom;

g) based on the signal or data indicative of the position of the joystick, determining a second joystick position difference between the actual component of the position of the joystick along the preset attachment actuation axis in a first time instant and a neutral position of the joystick along the second preset attachment actuation axis;

h) based on the signal or data indicative of the position of the attachment, determining a first position of the attachment along an attachment travel path in a first time instant;

i) based on the signal or data indicative of the position of the attachment, determining a second position of the attachment along the attachment travel path in the second time instant, successive with respect to the first time instant;

l) determining an attachment position difference between the second position and the first position of the attachment;

m) if the determined attachment position difference is lower than a predetermined attachment position difference threshold and the determined second joystick position difference is higher than a second predetermined joystick position difference threshold, supplying a reduced driving current or a null driving current to the second directional solenoid valve so as to slow down or stop the movement of the attachment.

All the preferred embodiments described above for the control method for actuating the movement of a boom and for the control method for actuating the movement of an attachment may be applied also to the control method for actuating the movement of the boom and the attachment attached to the boom in a work vehicle powered by a motor.

The present invention relates also to a control system for a work vehicle, comprising:

first input means adapted to receive at least a signal or data indicative of the position along a preset boom actuation axis in a control area of a joystick controlled by a user for actuating a boom, and second input means adapted to receive at least a signal or data indicative of the position of the boom along a boom travel path; and first output means adapted to issue at least a signal indicative of driving current intended to control an opening degree of a directional solenoid valve of hydraulic actuating means of the boom.

This control system is arranged to carry out a control method for actuating the movement of a boom according to the embodiments described above.

The invention relates also to a control system for a work vehicle, comprising:

first input means adapted to receive at least a signal or data indicative of the position along a preset attachment actuation axis in a control area of a joystick controlled by a user for actuating an attachment attached to a boom and second input means adapted to receive at least a signal or data indicative of the position of the attachment along an attachment travel path;

first output means adapted to issue at least a signal indicative of driving current intended to control an opening degree of a directional solenoid valve of hydraulic actuating means of the attachment.

This control system is arranged to carry out a control method for actuating the movement of an attachment according to the embodiments described above.

Clearly, a control system may be provided also for the control method for actuating the movement of the boom and the attachment attached to the boom in a work vehicle powered by a motor.

In such a case, the control system comprises:

first input means adapted to receive at least a signal or data indicative of the position along a preset boom actuation axis and along a preset attachment actuation axis in a control area of a joystick controlled by a user for actuating, respectively, a boom and an attachment attached to the boom;

second input means adapted to receive at least a signal or data indicative of the position of the boom along a boom travel path;

third input means adapted to receive at least a signal or data indicative of the position of the attachment along an attachment travel path;

first output means adapted to issue at least a signal indicative of driving current intended to control an opening degree of a first directional solenoid valve of first hydraulic actuating means of the boom;

second output means adapted to issue at least a signal indicative of driving current intended to control an opening degree of a second directional solenoid valve of second hydraulic actuating means of the attachment.

The control system will be arranged to carry out a control method for actuating the movement of the boom and the attachment attached to the boom according to example provided before.

The present invention relates also to a work vehicle, in particular compact wheel loader, comprising:

motor for propulsion of the work vehicle;

a boom;

a joystick operatively controlled by a user for actuating the boom, the joystick being movable in a predetermined control area according to a preset boom actuation axis for actuating the boom;

hydraulic actuating means for actuating the boom, wherein the hydraulic actuating means include a hydraulic cylinder operatively connected to the boom, and a directional solenoid valve whose opening degree is adapted to control the flow of a working fluid to the hydraulic cylinder, the opening degree of the directional solenoid valve being operatively controlled by means of a driving current thereof;

a hydraulic pump driven by the motor of the work vehicle to produce the hydraulic pressure of the working fluid;

first sensor means for detecting the position of the boom along a boom travel path;

a control system arranged to carry out a control method for actuating the movement of a boom, having the features described above.

Figure 4:
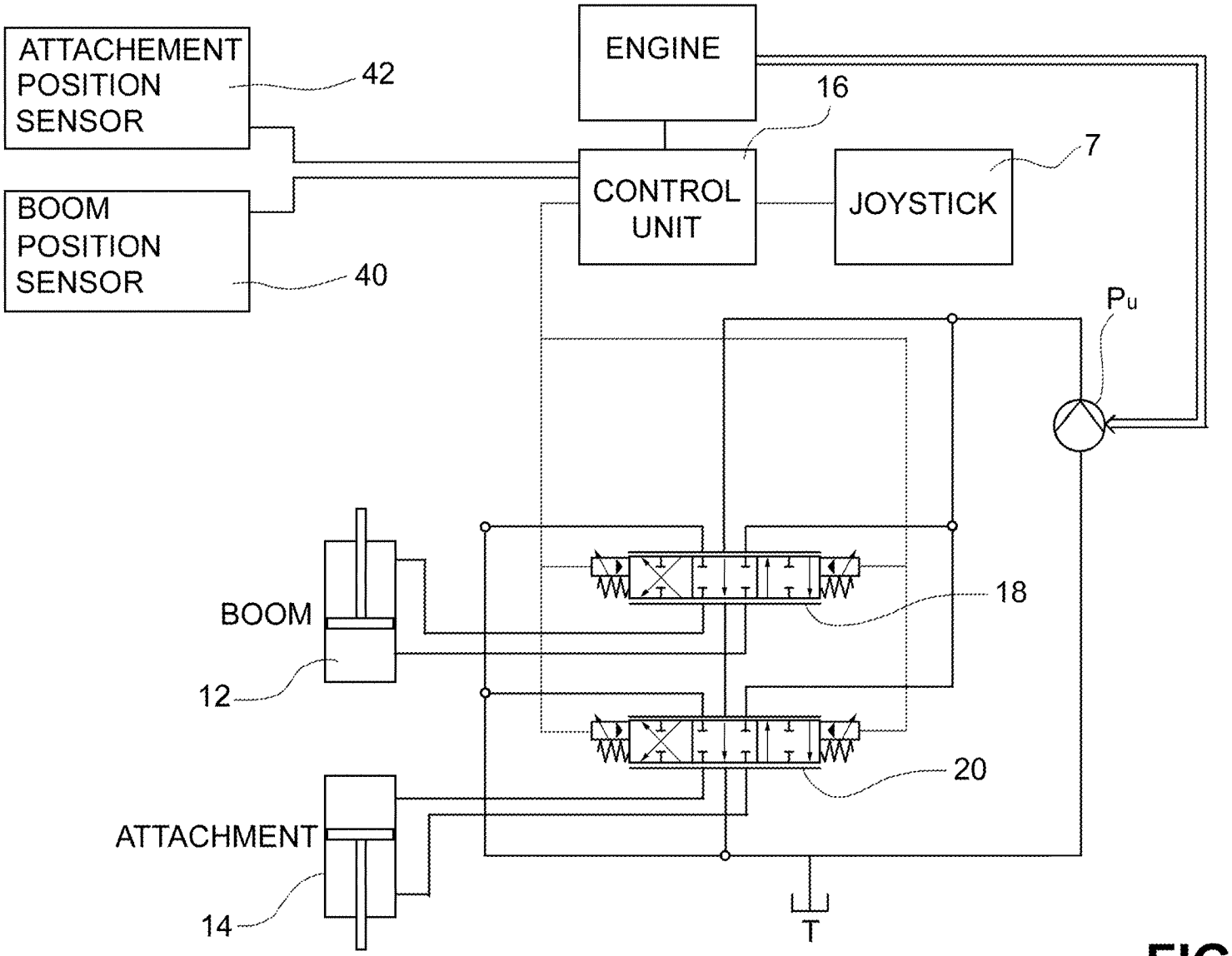
FIG. 4 shows a control diagram of a work vehicle according to the invention.

As indicated in FIG. 4, the first sensor means for detecting the position of the boom along a boom travel path may be a boom position sensor 40.

In a further aspect, the invention relates to a work vehicle, in particular compact wheel loader, comprising:

motor for propulsion of the work vehicle;

a boom;

an attachment connected to the boom;

a joystick operatively controlled by a user for actuating the attachment, the joystick being movable in a predetermined control area according to a preset attachment actuation axis for actuating the attachment;

hydraulic actuating means for actuating the attachment, wherein the hydraulic actuating means include a hydraulic cylinder operatively connected to the attachment, and a directional solenoid valve whose opening degree is adapted to control the flow of a working fluid to the hydraulic cylinder, the opening degree of the directional solenoid valve being operatively controlled by means of a driving current thereof;

a hydraulic pump driven by the motor of the work vehicle to produce the hydraulic pressure of the working fluid;

first sensor means for detecting the position of the attachment along an attachment travel path;

a control system arranged to carry out a control method for actuating the movement of an attachment, having the features described above.

As indicated in FIG. 4, the first sensor means for detecting the position of the attachment along an attachment travel path may be an attachment position sensor 42.

In addition, may be also provided a work vehicle, in particular compact wheel loader, comprising:

motor for propulsion of the work vehicle;

a boom;

an attachment connected to the boom;

a joystick operatively controlled by a user for actuating the attachment, the joystick being movable in a predetermined control area according to a preset boom actuation axis for actuating the boom and according to a preset attachment actuation axis for actuating the attachment;

first hydraulic actuating means for actuating the boom, wherein the first hydraulic actuating means include a first hydraulic cylinder operatively connected to the boom, and a first directional solenoid valve whose opening degree is adapted to control the flow of a working fluid to the first hydraulic cylinder, the opening degree of the first directional solenoid valve being operatively controlled by means of a driving current thereof;

second hydraulic actuating means for actuating the attachment, wherein the second hydraulic actuating means include a second hydraulic cylinder operatively connected to the attachment, and a second directional solenoid valve whose opening degree is adapted to control the flow of a working fluid to the second hydraulic cylinder, the opening degree of the second directional solenoid valve being operatively controlled by means of a driving current thereof;

a hydraulic pump driven by the motor of the work vehicle to produce the hydraulic pressure of the working fluid;

first sensor means for detecting the position of the boom along a boom travel path;

second sensor means for detecting the position of the attachment along an attachment travel path;

a control system arranged to carry out a control method for actuating the movement of the boom and the attachment attached to the boom having the feature described before.

As indicated in FIG. 4, the first sensor means for detecting the position of the boom along a boom travel path may be the boom position sensor 40 and the second sensor means for detecting the position of the attachment along an attachment travel path may be the attachment position sensor 42.

As an example, the boom position sensor 40 may be an angle detection sensor, or a linear sensor coupled to a cylinder of the boom, or a pressure sensor coupled to a bottom chamber of a cylinder of the boom. As an example, the attachment position sensor 42 may be an angle detection sensor, or a linear sensor coupled to a cylinder of the attachment, or a pressure sensor coupled to a bottom chamber of a cylinder of the attachment.

The example embodiments are described in sufficient detail to enable those of ordinary skill in the art to implement a control system in a work vehicle arranged to carry out the disclosed control method herein described.

Naturally, the principle of the invention remaining unchanged, the embodiments and the constructional details may vary widely from those described and illustrated purely by way of non-limiting example, without thereby departing from the scope of the invention as defined in the appended claims.

The invention claimed is:

1. A control method for actuating the movement of a boom in a work vehicle powered by a motor;

wherein actuating the boom occurs by means of a joystick controlled by an operator, a movement of the joystick in a predetermined control area according to a preset boom actuation axis causing the actuation of the boom by hydraulic actuating means, wherein the hydraulic actuating means include an hydraulic cylinder operatively connected the boom, and a directional solenoid valve whose opening degree is adapted to control the flow of a working fluid to the hydraulic cylinder;

the rate of actuation of the boom being controlled by the opening degree of the directional solenoid valve by means of a driving current thereof as a function of a component of the position of the joystick along the preset boom actuation axis in the control area;

the control method comprising the steps of:

acquiring, a signal or data indicative of the position of the joystick along the preset boom actuation axis and a signal or data indicative of the position of the boom along a boom travel path over time;

based on the signal or data indicative of the position of the joystick, determining a joystick position difference between the actual component of the position of the joystick along the preset boom actuation axis in a first time instant and a neutral position of the joystick along the preset boom actuation axis;

based on the signal or data indicative of the position of the boom, determining a first position of the boom along the boom travel path in the first time instant;

based on the signal or data indicative of the position of the boom, detecting a second position of the boom along the boom travel path in a second time instant, successive with respect to the first time instant;

determining a boom position difference between the second position and the first position of the boom;

if the determined boom position difference is lower than a predetermined boom position difference threshold and the determined joystick position difference is higher than predetermined joystick position difference threshold, supplying a reduced driving current or a null driving current to the directional solenoid valve so as to slow down or stop the movement of the boom.

2. The control method according to claim 1, further comprising the step of:

acquiring a signal or data indicative of operating mode of the work vehicle over time;

wherein the value of the predetermined boom position difference threshold is determined based on the operating mode indicated by the signal or data indicative of the operating mode of the work vehicle.

3. The control method according to claim 2, wherein a time interval between the first time instant and the second time instant is determined over time based on the operating mode indicated by the signal or data indicative of operating mode of the work vehicle.

4. The control method according to claim 1, further comprising the step of:

acquiring a signal or data indicative of a rotational speed of the motor of the work vehicle;

wherein the values of the predetermined joystick position difference threshold are determined based on the rotational speed indicated by the signal or data indicative of the rotational speed of the motor of the work vehicle.

5. A control system for a work vehicle, comprising:

first input means adapted to receive at least a signal or data indicative of the position along a preset boom actuation axis in a control area of a joystick controlled by an operator for actuating a boom;

second input means adapted to receive at least a signal or data indicative of the position of the boom along a boom travel path;

first output means adapted to issue at least a signal indicative of driving current intended to control an opening degree of a directional solenoid valve of hydraulic actuating means of the boom;

wherein the control system is configured to carry out a control method according to claim 1.

6. A control method for actuating the movement of an attachment attached to a boom in a work vehicle powered by a motor;

wherein actuating the attachment occurs by means of a joystick controlled by an operator, a movement of the joystick in a predetermined control area according to a preset attachment actuation axis causing the actuation of the attachment by hydraulic actuating means, wherein the hydraulic actuating means include an hydraulic cylinder operatively connected the attachment, and a directional solenoid valve whose opening degree is adapted to control the flow of a working fluid to the hydraulic cylinder;

the rate of actuation of the attachment being controlled by the opening degree of the directional solenoid valve by means of a driving current thereof as a function of a component of the position of the joystick along the preset attachment actuation axis in the control area;

the control method comprising the steps of:

acquiring, a signal or data indicative of the position of the joystick along the preset attachment actuation axis and a signal or data indicative of the position of the attachment along an attachment travel path over time;

based on the signal or data indicative of the position of the joystick, determining a joystick position difference between the actual component of the position of the joystick along the preset attachment actuation axis in a first time instant and a neutral position of the joystick along the preset attachment actuation axis;

based on the signal or data indicative of the position of the attachment along the attachment travel path, determining a first position of the attachment along an attachment travel path in the first time instant;

based on the signal or data indicative of the position of the attachment along the attachment travel path, determining a second position of the attachment along the attachment travel path in a second time instant, successive with respect to the first time instant;

determining an attachment position difference between the second position and the first position of the attachment;

if the determined attachment position difference is lower than a predetermined attachment position difference threshold and the determined joystick position difference is higher than predetermined joystick position difference threshold, supplying a reduced driving current or a null driving current to the directional solenoid valve so as to slow down or stop the movement of the attachment.

7. The control method according to claim 6, further comprising the step of:

acquiring a signal or data indicative of operating mode of the work vehicle over time;

wherein the value of the predetermined attachment position difference threshold is determined based on the operating mode indicated by the signal or data indicative of operating mode of the work vehicle.

8. The control method according to claim 7, wherein a time interval between the first time instant and the second time instant is determined over time based on the operating mode indicated by the signal or data indicative of operating mode of the work vehicle.

9. The control method according to claim 6, further comprising the step of:

acquiring a signal or data indicative of a rotational speed of the motor of the work vehicle;

wherein the values of the predetermined joystick position difference threshold are determined based on the rotational speed indicated by the signal or data indicative of the rotational speed of the motor of the work vehicle.

10. A control system for a work vehicle, comprising:

first input means adapted to receive at least a signal or data indicative of the position along a preset attachment actuation axis in a control area of a joystick controlled by an operator for actuating an attachment attached to a boom;

second input means adapted to receive at least a signal or data indicative of the position of the attachment along an attachment travel path;

first output means adapted to issue at least a signal indicative of driving current intended to control an opening degree of a directional solenoid valve of hydraulic actuating means of the attachment;

wherein the control system is configured to carry out a control method according to claim 6.

* * * * *